US008608272B2

(12) United States Patent
Lang

(10) Patent No.: US 8,608,272 B2
(45) Date of Patent: Dec. 17, 2013

(54) SYSTEM AND METHOD FOR INKJET PRINTING WITH A DIFFERENTIAL HALFTONED PROTECTIVE OVERCOAT WITH GLOSS COMPENSATION

(75) Inventor: Joseph H. Lang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 479 days.

(21) Appl. No.: 12/959,510

(22) Filed: Dec. 3, 2010

(65) Prior Publication Data

US 2012/0139984 A1 Jun. 7, 2012

(51) Int. Cl.
*B41J 2/205* (2006.01)

(52) U.S. Cl.
USPC ..... 347/15

(58) Field of Classification Search
USPC ..... 347/43, 15, 102, 14; 399/341, 321; 358/3.06
See application file for complete search history.

(56) References Cited

U.S. PATENT DOCUMENTS

| | | | |
|---|---|---|---|
| 4,357,900 | A | 11/1982 | Buschor |
| 5,196,236 | A | 3/1993 | Howard et al. |
| 5,635,969 | A | 6/1997 | Allen |
| 5,847,738 | A | 12/1998 | Tutt et al. |
| 6,059,404 | A | 5/2000 | Jaeger et al. |
| 6,102,537 | A | 8/2000 | Kato et al. |
| 6,106,623 | A | 8/2000 | Nishikawa |
| 6,170,881 | B1 | 1/2001 | Salmon et al. |
| 6,249,355 | B1 | 6/2001 | Trask |
| 6,369,844 | B1 | 4/2002 | Neumann et al. |
| 6,681,095 | B1 | 1/2004 | Tsuda |
| 6,877,850 | B2 | 4/2005 | Ishimoto et al. |
| 6,925,281 | B2 | 8/2005 | Weber et al. |
| 6,939,002 | B2 | 9/2005 | Janosky et al. |
| 6,993,272 | B2 | 1/2006 | Lange et al. |
| 7,152,950 | B2 | 12/2006 | Takekoshi et al. |
| 7,178,898 | B2 | 2/2007 | Hoshino |
| 7,180,635 | B2 | 2/2007 | Wang et al. |
| 7,184,177 | B2 | 2/2007 | Trelewicz et al. |
| 7,196,714 | B2 | 3/2007 | Someno |
| 7,275,804 | B2 | 10/2007 | Matsushima |
| 7,301,675 | B2 | 11/2007 | Wang et al. |
| 7,304,770 | B2 | 12/2007 | Wang et al. |
| 7,305,200 | B2 | 12/2007 | Hoffman et al. |
| 7,324,241 | B2 | 1/2008 | Eschbach et al. |

(Continued)

FOREIGN PATENT DOCUMENTS

| | | |
|---|---|---|
| EP | 1223046 | 7/2002 |
| JP | 04355156 A | 12/1992 |

OTHER PUBLICATIONS

EP Search Report corresponding to European Patent Application 09155428, European Patent Office, Munich Germany, May 10, 2010 (6 pages).

*Primary Examiner* — Stephen Meier
*Assistant Examiner* — Carlos A Martinez
(74) *Attorney, Agent, or Firm* — Maginot, Moore & Beck, LLP

(57) ABSTRACT

A method for operating an inkjet imaging system includes generating a coverage area map that identifies areas of an image that have different coverage area densities. Color inkjet ejectors form an image on an image receiving member, and clear inkjet ejectors eject halftone patterns on the image receiving member and on the ink forming the image. The halftone levels of the clear ink in each area on the image and image receiving member are selected in response to the coverage area density for each area.

20 Claims, 7 Drawing Sheets

(56) References Cited

U.S. PATENT DOCUMENTS

| | | | | |
|---|---|---|---|---|
| 7,338,143 | B2 | 3/2008 | Onishi et al. | |
| 7,382,495 | B2 | 6/2008 | Liu et al. | |
| 7,495,798 | B2 | 2/2009 | Kakutani | |
| 7,508,544 | B2 | 3/2009 | Kakutani | |
| 7,510,277 | B2 | 3/2009 | Konno et al. | |
| 7,511,855 | B2 | 3/2009 | Butterfield et al. | |
| 7,533,982 | B2 | 5/2009 | Yoneyama | |
| 7,578,587 | B2 | 8/2009 | Belelie et al. | |
| 2003/0007814 | A1* | 1/2003 | Richards | 399/341 |
| 2003/0142343 | A1 | 7/2003 | Bezenek | |
| 2005/0179725 | A1 | 8/2005 | Matsushima | |
| 2006/0284929 | A1* | 12/2006 | Matsuzawa et al. | 347/43 |
| 2008/0079971 | A1 | 4/2008 | Liu et al. | |
| 2008/0248196 | A1 | 10/2008 | Anderson et al. | |
| 2009/0237425 | A1 | 9/2009 | Lang | |
| 2009/0262159 | A1* | 10/2009 | Lang | 347/15 |
| 2009/0263172 | A1 | 10/2009 | Kovacs | |
| 2010/0150620 | A1* | 6/2010 | Ng et al. | 399/321 |
| 2010/0194838 | A1* | 8/2010 | Mitsuzawa | 347/102 |
| 2011/0032299 | A1* | 2/2011 | Mimura | 347/15 |
| 2011/0222126 | A1* | 9/2011 | Asai et al. | 358/3.06 |
| 2011/0249051 | A1* | 10/2011 | Chretien et al. | 347/14 |

* cited by examiner

SYSTEM AND METHOD FOR INKJET PRINTING WITH A DIFFERENTIAL HALFTONED PROTECTIVE OVERCOAT WITH GLOSS COMPENSATION

TECHNICAL FIELD

The present disclosure relates to inkjet printing, and, in particular, to phase change inkjet printing systems employing clear ink overcoats.

BACKGROUND

In general, inkjet printing machines or printers include at least one printhead that ejects drops or jets of liquid ink onto a recording or image forming media. Such ink may be phase change ink, aqueous, oil, solvent-based, or UV curable ink or an ink emulsion. A phase change inkjet printer employs phase change inks that are in the solid phase at ambient temperature, but transition to a liquid phase at an elevated temperature. A printhead may then eject the molten ink directly onto an image receiving substrate, or indirectly onto an intermediate imaging member before the imaging member transfers the image to an image receiving substrate. Once the ejected ink is on the image receiving substrate, the ink droplets quickly solidify to form an image. One common image receiving substrate is paper that has been cut into sheets or formed in a continuous media web.

In both the direct and offset printing architecture, images may be formed on a media sheet or a media web. In a web printer, a continuous supply of media, typically provided in a media roll, is mounted onto rollers that are driven by motors. A loose end of the media web is passed through a print zone opposite the printhead or printheads of the printer. Beyond the print zone, the media web is gripped and pulled by mechanical structures so a portion of the media web continuously moves through the print zone. Tension bars or rollers may be placed in the feed path of the moving web to remove slack from the web so the web remains taut without breaking.

In a typical phase change ink direct printing system, melted phase change ink is ejected from inkjets in the printhead directly onto the final receiving web or sheet. In phase change ink continuous-web printing, a high pressure roller nip, also referred to as a spreader, is used after the melted phase change ink is jetted onto the web to spread the ink on the web to achieve the desired print quality. The function of the spreader is to take what are essentially isolated droplets of ink on web and smear them out to make a continuous layer by pressure and/or heat so that spaces between adjacent drops are filled and image solids become more uniform. Other methods of spreading or fixing ink are also possible such as with heat or pressure alone.

In a typical phase change ink indirect printing system, ink is ejected from jets in the printhead onto an intermediate image receiving member, such as a print drum or endless belt. Images formed on the image receiving member are then transferred to a media sheet by passing the media sheet through a nip formed between the image receiving member and a high-pressure transfix roller in a process also referred to as "transfixing" the image.

One difficulty faced in imaging devices, and in particular, imaging devices that utilize phase change ink to form images, is ink abrasion during handling of the prints. Two types of ink abrasion include ink rub and ink offset. Ink rub refers to the smearing or scuffing of the ink of an image on a receiving substrate, such as a sheet of paper. Ink offset refers to ink from an image formed on a surface or portion of a surface of a receiving substrate being transferred to another surface or another portion of the substrate. Ink rub and ink offset are particularly concerns for applications that require extensive handling, such as the outside of envelopes or printed sheets inserted into envelopes. The prior art media sheet depicted in FIG. 7A provides a cross-sectional view of an ink image that includes ink layer 704 on media sheet 708. Ink layer 704 is exposed on the surface of media sheet 708, and is susceptible to ink abrasion.

To prevent ink abrasion, some previously known systems utilize a protective coating, such as varnish, applied over the printed image on the substrate to prevent or minimize damage due to abrasion of the printed image. For example, a varnisher places a protective coating over the entire image to prevent abrasion of ink in the resulting prints. In some previously known systems, overlaying clear ink may require coverages greater than 50% because the act of spreading the ink in the spreader brings all of the ink to a common level and if the overlay of clear ink does not completely cover the colored ink, some of the colored ink may end up at the surface where it is susceptible to abrasion. An example of overlaying clear ink with 100% coverage of an imaged portion of a media sheet is depicted in FIG. 7B. A clear ink layer 712 completely covers ink layer 704 on print medium 708. While high coverage clear coatings applied over images formed on a substrate may be useful to prevent or minimize damage due to ink abrasion of the images, the addition of the clear coating material adds to the expense of the print, and the increased expense due to the coating is commensurate with the amount of coating used per print.

The overall quality of imaged print media also includes a measurement of the glossiness of a print medium after imaging. The glossiness, also referred to as a gloss level, of a printed medium refers to ability of the print medium to reflect light in a specular, or mirror-like, manner with an angle of incident light being approximately equal to the angle of reflected light for a surface with a high gloss level. The factors that affect gloss are the refractive index of the material, the angle of incident light, and the surface topography. A common example of a high-gloss image is a photograph printed on photographic paper, while a common example of a low-gloss or "matte" image is black and white text printed on plain-paper. The ink used to form an image on a print medium may have a different gloss level than the underlying print medium. Certain phase-change inks have gloss levels that exceed the gloss levels of standard printing paper stock. In situations where a high gloss level is desirable, the higher gloss levels of the phase change ink are advantageous. However, the inconsistency between non-imaged portions of the underlying print medium with a low gloss level and imaged portions of the print medium with a high gloss level may detract from the overall appearance of the imaged print medium. Given these challenges, a printing system that protects ink in a print image from damage due to abrasion while producing printed media having uniform gloss levels benefits the field of inkjet printing.

SUMMARY

A new method of inkjet printing has been developed. The method includes receiving digital data corresponding to an image to be printed with an inkjet printing apparatus, generating a coverage area map that identifies areas of the image to be printed that have different coverage area densities, selecting a halftone level for clear ink to be ejected onto each area identified by the coverage area map, operating a first plurality of inkjet ejectors for the inkjet printing apparatus to form the image to be printed on an image receiving member with at least one colored ink, and operating a second plurality of inkjet ejectors to eject clear ink at the selected halftone levels onto the image receiving surface. The halftone level selected for each area corresponds to the coverage area density for the area. The second plurality of inkjet ejectors operate with reference to the selected halftone levels to eject different amounts of clear ink onto the different areas identified by the coverage area map.

A new printer has been developed. The printer includes a media transport system configured to transport print media along a media path, a print station positioned along the media path, a clear ink station positioned along the media path, and a controller. The print station includes a first plurality of inkjet ejectors configured to eject drops of ink having at least one color. The clear ink station includes a second plurality of inkjet ejectors configured to eject drops of clear ink. The controller is configured to receive digital data corresponding to an image to be printed with an inkjet printing apparatus, generate a coverage area map that identifies areas of the image to be printed that have different coverage area densities, select a halftone level for clear ink to be ejected onto each area identified by the coverage area map, operate the media transport system to move the print media past the print station and clear ink station, operate the first plurality of inkjet ejectors in the print station with reference to the digital data to form an image on a surface of the print media by ejecting ink drops having the at least one color, and operate the second plurality of inkjet ejectors in the clear ink station to eject clear ink at the selected halftone levels onto the image receiving surface. The halftone level selected for each area corresponds to the coverage area density for the area. The second plurality of inkjet ejectors operate with reference to the selected halftone levels to eject different amounts of clear ink onto the different areas identified by the coverage area map.

In another embodiment, a new printer has been developed. The printer includes an image receiving member, a transfix member, a media transport system configured to transport print media along a media path, a print station positioned opposite the image receiving member, a clear ink station positioned along the media path, and a controller. The print station includes a first plurality of inkjet ejectors configured to eject drops of ink having at least one color. The clear ink station includes a second plurality of inkjet ejectors configured to eject drops of clear ink. The controller is configured to receive digital data corresponding to an image to be printed with an inkjet printing apparatus, generate a coverage area map that identifies areas of the image to be printed that have different coverage area densities, select a halftone level for clear ink to be ejected onto each area identified by the coverage area map, operate the media transport system to move the print media between the image receiving member and the transfix member and past the clear ink station, operate the first plurality of inkjet ejectors in the print station with reference to the digital data to form an image on the image receiving member by ejecting ink drops having the at least one color, operate the transfix member and image receiving member to transfix the image onto a surface of a print medium, and operate the second plurality of inkjet ejectors in the clear ink station to eject clear ink at the selected halftone levels onto the surface of the print medium. The halftone level selected for each area corresponds to the coverage area density for the area. The second plurality of inkjet ejectors operate with reference to the selected halftone levels to eject different amounts of clear ink onto the different areas identified by the coverage area map.

DETAILED DESCRIPTION

Figure 1A:
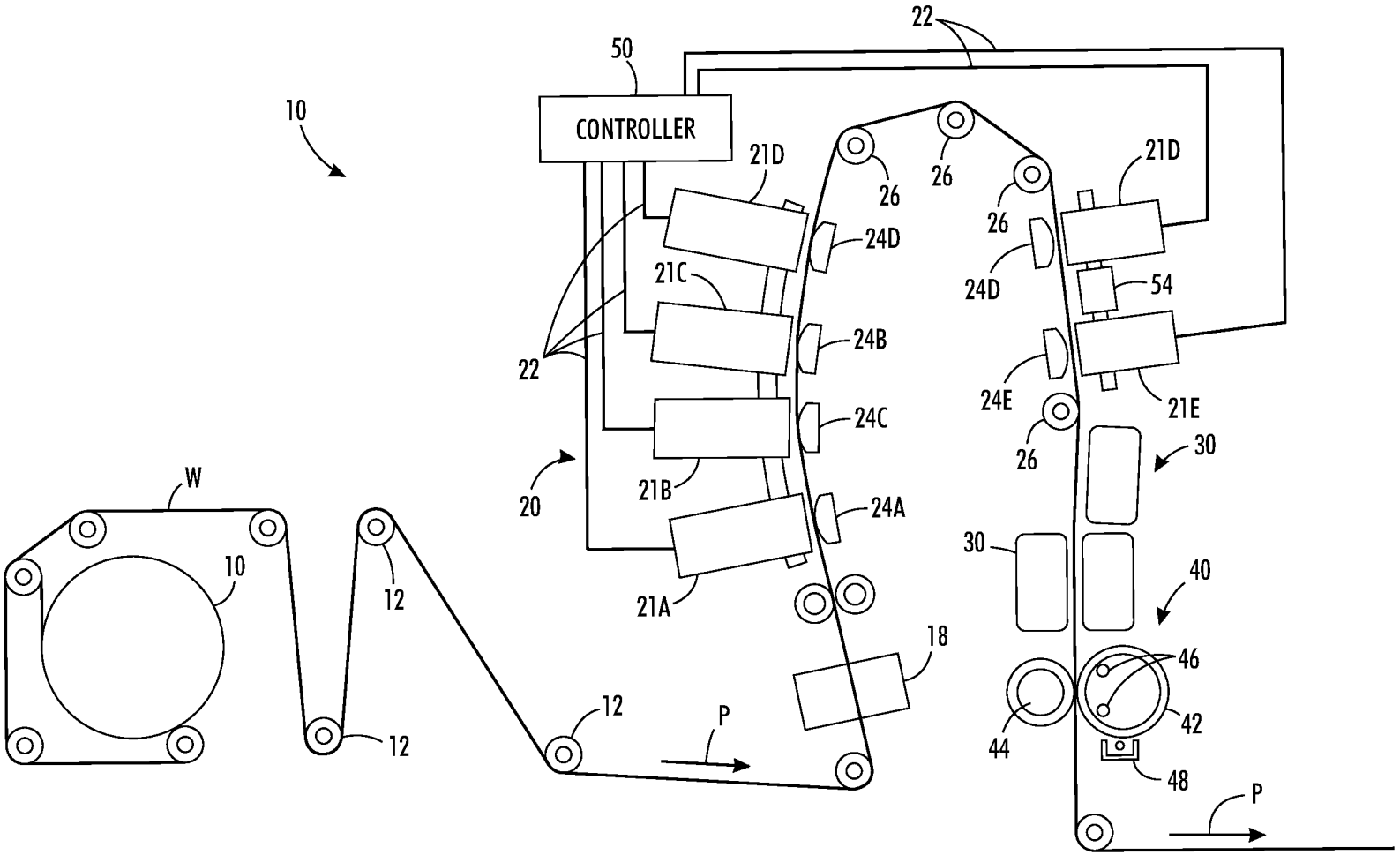
FIG. 1A is a schematic view of a continuous web direct printing system configured to eject halftone patterns of a clear ink onto a media web.

For a general understanding of the environment for the system and method disclosed herein as well as the details for the system and method, reference is made to the drawings. In the drawings, like reference numerals have been used throughout to designate like elements. As used herein, the term "halftone" refers to the application of an ink in a pattern to a print medium where the ink partially covers the area to which it is applied. A halftone level refers to the fraction or percentage of the surface of the printed area that the ink covers. For example, printing ink with a 50% halftone level covers one-half of the target surface area of the image receiver with ink, while the remaining 50% remains uncovered. A 100% halftone is equivalent to solid coverage of a target area of the media surface with ink and a 0% halftone applies no ink to a given target area. As used herein, the term "gloss level" refers to the degree to which a material, such as a printed medium, reflects light in a mirror-like manner with angle of incident light being approximately equal to the angle of reflected light for a surface with a high gloss level. The term "pixel" refers to a location on the image receiving member where an ink drop may land during an imaging operation. An ink image is formed from one or more ink drops ejected to various pixel locations. The term "coverage area map" refers to a data structure that contains information on the density of ink present in various areas of the image receiving member, where each area includes one or more pixels. The term "coverage area density" refers to a number of ink drops ejected into a target area and the total number of ink drops that could be ejected into the target area.

Figure 1B:
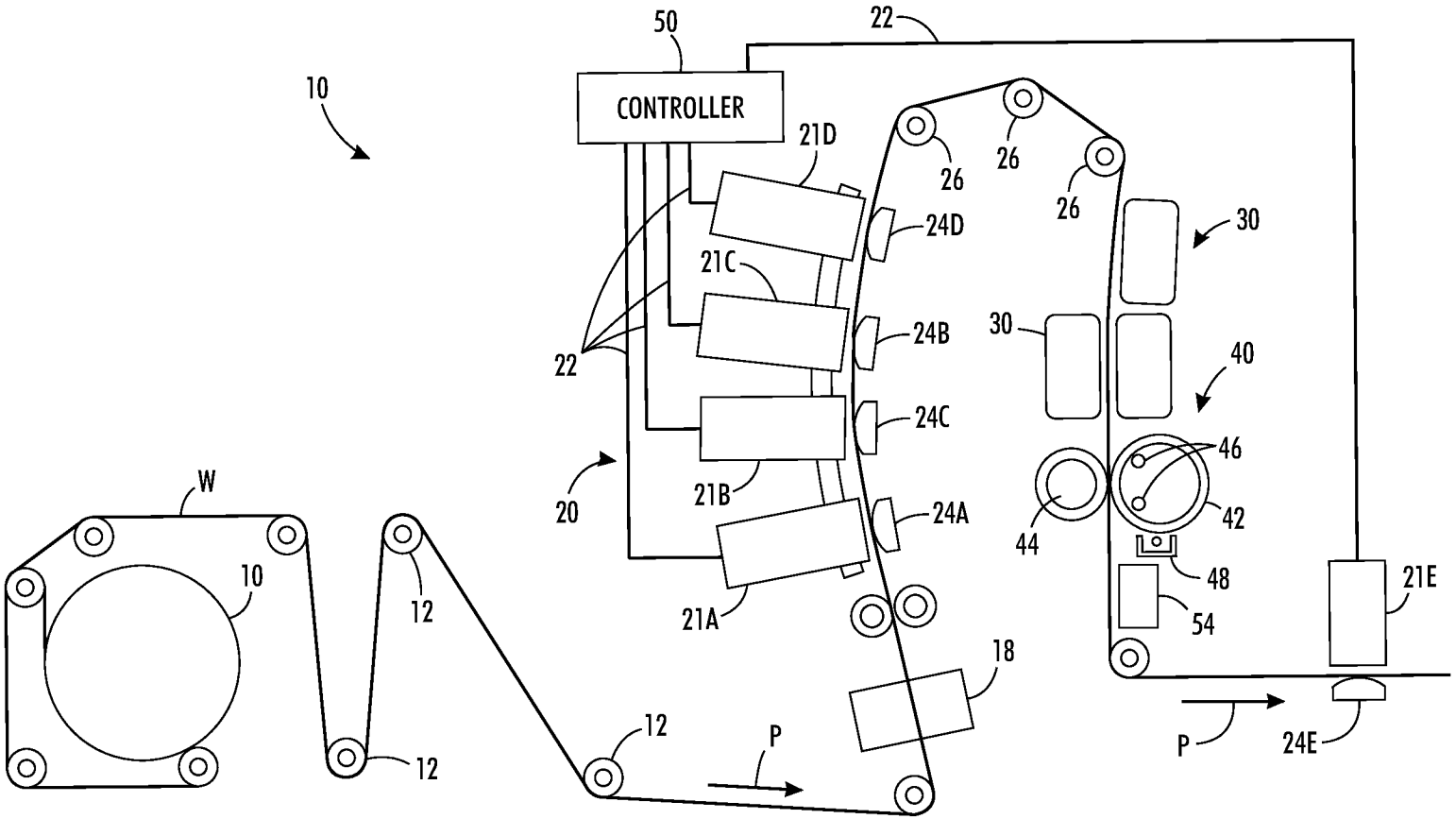
FIG. 1B is a schematic view of an alternative configuration of the continuous web direct printing system of FIG. 1A.

FIG. 1A and FIG. 1B depict two simplified configurations of a direct-to-sheet, continuous-web, phase-change ink printer. In both FIG. 1A and FIG. 1B, a web supply and handling system is configured to supply a very long (i.e., substantially continuous) web W of "substrate" (paper, plastic, or other printable material) from a spool 10. The web W may unwind as needed, and a variety of motors, not shown, may propel web W in process direction P. A set of rolls 12 controls the tension of the unwinding web as the web moves through a path.

Along the path P a preheater 18, brings the web to an initial predetermined temperature. The preheater 18 can rely on contact, radiant, conductive, or convective heat to bring the web W to a target preheat temperature, which in one practical embodiment, is in a range of about 30° C. to about 70° C.

The web W moves through a printing station 20 including a series of printheads 21A, 21B, 21C, and 21D, each printhead effectively extending across the width of the web and being able to place ink of one primary color directly (i.e., without use of an intermediate or offset member) onto the moving web. As is generally familiar, each of the four primary-color images placed on overlapping areas on the web W combine to form a full-color image, based on the image data sent to each printhead through image data path 22 from controller 50. In various possible embodiments, multiple printheads may eject ink for each primary color, the printheads can each be formed into a single or multiple linear array or arrays, multiple distinct printheads located at different locations along the process direction can apply one or more ink colors, or the printheads or portions thereof can be mounted movably in a direction transverse to the process direction P, such as for spot-color applications.

In one embodiment, the ink utilized in the imaging device 10 is a "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink.

Associated with each printhead is a backing member 24A-24D, typically in the form of a bar or roll, which is arranged substantially opposite the printhead on the other side of web W. Each backing member is used to position the web W so that the gap between the printhead and the sheet stays at a known, constant distance. Each backing member may be configured to emit thermal energy to aid in heating the web to an operational temperature range that is between about 40° C. to about 60° C. in one practical embodiment. The preheater 18, the printheads, backing members 24A-24E (if heated), as well as the surrounding air combine to maintain the web W in the printing zone 20 in a predetermined temperature range of about 40° C. to 70° C.

As the partially-imaged web moves to receive inks of various colors throughout the printing station 20, the temperature of the web is maintained within a given range. Ink is jetted at a temperature typically significantly higher than the receiving web's temperature which heats the surrounding paper (or whatever substance the web W is made of). Therefore, the members in contact with or near the web in zone 20 must be adjusted to maintain an operational web temperature. For example, although the backing members may have an effect on the web temperature, the air temperature and air flow rate behind and in front of the web may also impact the web temperature. Accordingly, air blowers or fans may be utilized to facilitate control of the web temperature.

The web temperature is kept substantially uniform for the jetting of all inks from printheads in the printing zone 20. Various preheaters, uncontrolled backer members, and controller backer members, such as backer members 24A-24E, may maintain a uniform temperature in the printing station for inks and webs having different thermal properties. Temperature sensors (not shown) associated with the web W may supply a control system with web temperature data. Data obtained from systems for measuring or inferring (from the image data, for example) how much ink of a given color a printhead applies to the web W at a given time may also indicate the web temperature. The various backer members can be controlled individually, using input data from the printhead adjacent thereto, as well as from other printheads in the printing station.

In the embodiment of FIG. 1A, printhead 21E and backing member 24E are positioned to follow printheads 21A-21D and their associated backing members 24A-24D in the process direction P. Printhead 21E is configured to eject a clear ink onto the surface of media web W after printheads 21A-21D form images on the media web. Printhead 21E is operatively coupled with controller 50 through image data path 22. Controller 50 sends firing signals to printhead 21E instructing printhead 21E to eject halftone patterns of clear ink over various portions of media web W. Controller 50 may control the locations and clear ink halftone levels that printhead 21E ejects accordance with a process described in FIG. 4 below. Printhead 21E may eject ink over imaged areas of the media web as well as bare portions of the media web. The clear ink over the imaged area protects the ink forming the image from damage due to ink abrasion after the imaging process is completed. The selected clear ink halftone applied over the imaged area may provide a predetermined level of image protection while minimizing the overall usage of clear ink. A halftone level of approximately 50% coverage of the imaged area is a common example.

Printhead 21E may also eject clear ink drops onto bare locations of media web W that are otherwise free of colored ink. These areas do not contain ink ejected from printheads 21A-21D. Clear ink ejected onto bare portions of media web W alters the gloss level of the underlying media web surface. The second halftone level is selected based on a predetermined gloss level. For many low-cost media web materials such as uncoated paper, a higher clear ink halftone level promotes a higher gloss level. Thus, a higher halftone level may increase the gloss level of the underlying print medium, and a lower halftone level lowers the gloss level and reduces the usage of clear ink. In the embodiment of FIG. 1A, printhead 21E is located within print zone 20 after printheads 21A-21D, and before spreader 40, as described in detail below.

Referring again to FIG. 1A and FIG. 1B, following the printing zone 20 along the web path is a series of tension rolls 26, followed by one or more "midheaters" 30. The midheater 30 may use contact, radiant, conductive, and/or convective heat to bring the web W to the target temperature. The midheater 30 brings the ink placed on the web to a temperature suitable for spreading ink when the ink on the web passes through the spreader 40. In one embodiment, a useful range for a target temperature for the midheater is about 35° C. to about 80° C. The midheater 30 has the effect of equalizing the ink and substrate temperatures to within about 15° C. of each other. Lower ink temperature gives less line spread while higher ink temperature causes show-through (visibility of the image from the other side of the print). The midheater 30 adjusts substrate and ink temperatures to 0° C. to 20° C. above the temperature of the spreader, which is described below.

Following the midheaters 30, along the path of web W, is a fixing assembly 40 that is configured to apply heat and/or pressure to the web to fix the images to the web. The fixing assembly may include any suitable device or apparatus for fixing images to the web including heated or unheated pressure rollers, radiant heaters, heat lamps, and the like. In the embodiment of the FIG. 1A, the fixing assembly includes a "spreader" 40, that applies a predetermined pressure, and in some implementations, heat, to the web W. The function of the spreader 40 is to take what are essentially droplets, strings of droplets, or lines of ink on web W and smear them so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the web W. Either roll can include heat elements such as 46 to bring the web W to a temperature in a range from about 35° C. to about 80° C.

In one practical embodiment, the roll temperature in spreader 40 is maintained at a temperature that depends on the properties of the ink such as 55° C. In some embodiments, a lower roll temperature provides less line spread while a higher temperature causes imperfections in the gloss. Ink may offset from the roll if roll temperatures are too high. In one practical embodiment, the pressure applied to web W between image-side roll 42 and pressure roll 44 is set in a range of about 500 to about 2000 psi lbs/side. Lower pressures provide less line spread while higher pressures may reduce pressure roll life.

The spreader 40 can also include a cleaning/oiling station 48 associated with image-side roll 42, suitable for cleaning and/or applying a layer of some lubricant or other material to the roll surface. Such a station coats the surface of the spreader roll with a lubricant, such as amino silicone oil having a viscosity of about 10-200 centipoises. Only small amounts of oil are required and the oil transferred to the web W is only about 1-10 mg per A4 size page. In one possible embodiment, the midheater 30 and spreader 40 occupy a single unit, with their respective functions occurring relative to the same portion of web W simultaneously. In another embodiment the web is maintained at a high temperature in the print zone to enable spreading of the ink as it is printed. The spreader is thus incorporated into the print zone as the ink is allowed to flow by extending the time it spends in the liquid state.

Following passage through the spreader 40 the printed web can be imaged on the other side, and then cut into pages, such as for binding (not shown). Although printing on a substantially continuous web is shown in the embodiment, the system described above can be applied to a cut-sheet system as well. Different preheat, midheat, and spreader temperature setpoints can be selected for different types of ink and/or weights of web media.

The embodiments of FIG. 1A and FIG. 1B include an optional optical sensor 54. Optical sensor 54 measures light reflected from the image receiving member, including ink formed on the image receiving member and light reflected from the bare portions of the image receiving member. A controller such as controller 50 may generate image data from the measurements, including coverage area maps and coverage area densities of ink corresponding to the detected light. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used. Optical sensor 54 is positioned after the color printheads 21A-21D and before the clear ink printhead 21E on process path P. In the embodiment of FIG. 1B, optical sensor 54 detects light reflected from the image receiving member after the image receiving member passes through spreader 40. Thus, optical sensor 54 detects light reflected from the image receiving member after an ink image is formed on the image receiving member, and before clear ink is applied to the image receiving member.

Figure 3A:
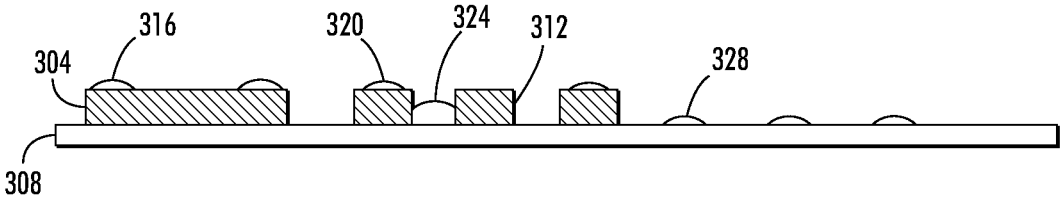
FIG. 3A is a cross-sectional view of a print medium with a partially imaged surface including halftone patterns of clear ink where the halftone pattern is formed prior to a spreading process.

An exemplary cross-sectional view of clear ink halftone patterns ejected from printhead 21E in FIG. 1A is depicted in FIG. 3A. A print medium 308 includes an imaged area with solid coverage of ink 304, an area with a halftone ink pattern 312, and a bare area covered with a halftone pattern of clear ink 328. In the example of FIG. 3A, a first halftone pattern of clear ink 316 covers the area with solid ink coverage 304, to provide a protective coating to the ink. A second clear ink halftone pattern covers the halftoned ink area 312 including clear ink 320 and 324. Clear ink 320 provides a protective cover to the ink in the halftone pattern and clear ink 324 covers portions of the bare print medium 308 to reduce difference in gloss level between the halftone region 312 and the rest of the print medium. The halftone pattern of clear ink 328 reduces the difference in gloss levels between areas of the print medium 308 containing ink and bare areas. In embodiments where bare medium 308 has a high gloss level, clear ink 328 may reduce the gloss level on the bare medium 308, while in embodiments where bare medium 308 has a low gloss level, clear ink 328 increases the gloss level on the bare medium. Controller 50 may operate clear ink printhead 21E to form various halftone levels on the image receiving member according to a printing process, such as process 400 described below. A clear ink that permits light to reflect from the underlying colored ink layer 304 and print medium 308 without substantially altering the color of the underlying layers forms clear ink drops 312 and 316. The clear ink is also selected to be more resistant to damage due to ink abrasion than the underlying colored ink. Since printhead 21E ejects the clear ink drops prior to the print medium 308 passing through spreader 40, the resulting heat and pressure flattens the clear ink formed over the ink image and the image receiving member.

In the embodiment of FIG. 1B, printhead 21E and backing member 24E are located in a position along process direction P after spreader 40. Printhead 21E ejects clear ink in various halftone patterns in the same manner as described with reference to FIG. 1A. The clear ink halftone patterns of FIG. 1B are ejected after the media web has passed through spreader 40, resulting in less spreading of the clear ink drops when compared to the clear ink drops produced by the configuration of FIG. 1A.

Figure 3B:
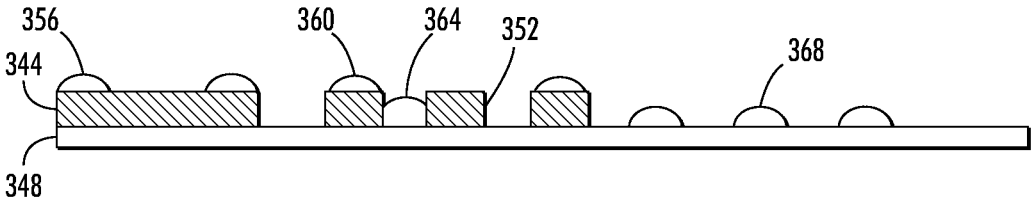
FIG. 3B is a cross-sectional view of a print medium with a partially imaged surface including halftone patterns of clear ink where the halftone pattern is formed after a spreading process.

An exemplary cross-sectional view of clear ink halftone patterns ejected from printhead 21E in FIG. 1B is depicted in FIG. 3B. A print medium 348 includes an imaged area with a solid coverage of ink 344, an area with a halftone ink pattern 352, and a bare area covered with a halftone pattern of clear ink 368. In the example of FIG. 3B, a first halftone pattern of clear ink 356 covers the area with solid ink coverage 344 to provide a protective coating to the ink. A second clear ink halftone pattern covers the halftoned ink area 352 including clear ink 360 and 364. Clear ink 360 provides a protective cover to the ink in the halftone pattern and clear ink 364 covers portions of the bare print medium 348 to reduce difference in gloss level between the halftone region 352 and the rest of the print medium. The halftone pattern of clear ink 368 reduces the difference in gloss levels between areas of the print medium 348 containing ink and bare areas. Controller 50 may operate clear ink printhead 21E to form various halftone levels on the image receiving member according to a process such as process 400 described below. In comparison to FIG. 3A, the clear ink halftone patterns of FIG. 3B include drops having a greater thickness since the clear ink is applied after the print medium 348 passes through spreader 40, while the clear ink drops in FIG. 3A have been smeared by the spreader 40. In embodiments where the gloss level of clear ink 328 is higher than bare medium 308, the gloss level of the halftone in the non-imaged area 328 in FIG. 3A has a higher gloss level than the corresponding area 368 in FIG. 3B due to the spreader flattening the clear ink droplets in FIG. 3A.

Figure 2:
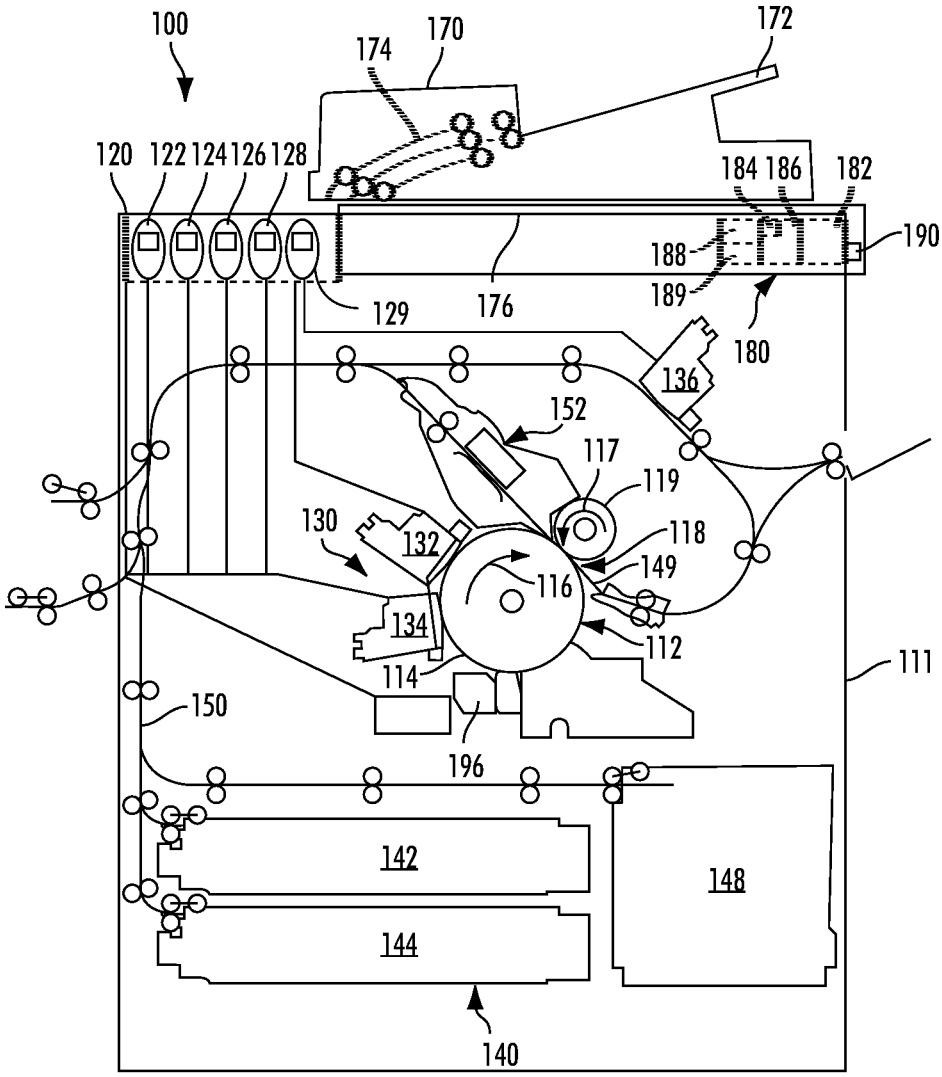
FIG. 2 is a schematic view of an indirect inkjet printing system configured to eject halftone patterns of a clear ink onto a media sheet.

FIG. 2 depicts an indirect printing device configured to eject clear ink drops in halftone patterns. As illustrated, a phase change ink imaging device or printer 100 includes a frame 111 to which are mounted directly or indirectly all its operating subsystems and components, as described below. To start, the phase change ink imaging device or printer 100 includes an image receiving member 112 that is shown in the form of a drum, but can equally be in the form of a supported endless belt. The image receiving member 112 has an imaging surface 114 that is movable in the direction 116, and on which phase change ink images are formed. A transfix roller 119 loads against the surface 114 of drum 112 under pressure, forming a transfix nip 118. Transfix roller 119 may rotate in direction 117, and ink images formed on the surface 114 may transfix onto a heated media sheet 149 passing through transfix nip 118.

The phase change ink imaging device or printer 100 also includes a phase change ink delivery subsystem 120 that has at least one source 122 of one color phase change ink in solid form. The example phase change ink imaging device 100 uses multiple colors of ink to form multicolor images on print media. The exemplary ink delivery system 120 includes four (4) sources 122, 124, 126, 128, representing four (4) different colors CMYK (cyan, magenta, yellow, black) of phase change inks, although alternative imaging devices may use fewer ink colors, additional ink colors, or different ink colors. Ink delivery system 120 also includes a fifth source 129 of a clear ink. The phase change ink delivery system also includes a melting and control apparatus (not shown) for melting or phase changing the solid form of the phase change ink into a liquid form. The phase change ink delivery system is suitable for supplying the liquid form to a printhead system 130 including at least one print station, or printhead assembly 132. The phase change ink imaging device or printer 100 is a wide format, multicolor image producing machine. The printhead system 130 includes multiple multicolor ink printhead assemblies, 132 and 134 as shown. In the embodiment illustrated, each printhead assembly further consists of two independent printheads. The total number of four printheads is staggered so the array of printheads covers substantially the full imaging width of the largest intended media size. Solid ink printers may have one or any number of any size printheads arranged in any practical manner.

Printer 100 includes a clear ink printhead assembly 136 positioned to eject clear ink drops onto media sheet 149 after media sheet 149 has had an image transfixed by passing through transfix nip 118. Clear ink printing station 136 includes one or more printheads that are in fluid communication with clear ink supply 129 and are operatively connected to controller 180. Clear ink printing station 136 is configured to eject halftone patterns of clear ink onto portions of media sheet 149 containing a transfixed image and onto portions that are outside the transfixed imaged areas.

As further shown, the phase change ink imaging device or printer 100 includes a substrate supply and handling system 140. The exemplary substrate supply and handling system 140 includes sheet or substrate supply sources 142, 144, 148. Supply source 148 is a high capacity paper supply or feeder for storing and supplying image receiving substrates in the form of cut sheets 149. The substrate supply and handling system 140 also includes a substrate handling and treatment system 150 that has a substrate heater or pre-heater assembly 152. The phase change ink imaging device or printer 100 as shown may also include an original document feeder 170 that has a document holding tray 172, document sheet feeding and retrieval devices 174, and a document exposure and scanning system 176.

A controller or electronic subsystem (ESS) 180 may direct operation and control of various subsystems, components and functions of the imaging device 100. The ESS or controller 180, for example, is a self-contained, dedicated mini-computer having a central processor unit (CPU) 182 with electronic storage 184, and a display or user interface (UI) 186. The ESS or controller 180, for example, includes a sensor input and control circuit 188 as well as a pixel placement and control circuit 189. In addition, the CPU 182 reads, captures, prepares, and manages the image data flow between image input sources, such as the scanning system 176, or an online or a work station connection 190, and the printhead assemblies 132 and 134. As such, the ESS or controller 180 is the main multi-tasking processor for operating and controlling all of the other machine subsystems and functions.

Various implementations of controller 180 may include general or specialized programmable processors that execute programmed instructions. The instructions and data required to perform the programmed functions may be stored in memory associated with the processors. These components may be provided on a printed circuit card or provided as a circuit in an application specific integrated circuit (ASIC). Different implementations of the circuits may include a separate processor or multiple circuits implemented on the same processor. Alternatively, the circuits may include discrete components or circuits provided in VLSI circuits. Embodiments of circuits described herein may additionally include a combination of processors, ASICs, discrete components, or VLSI circuits. Multiple controllers configured to communicate with a main controller 180 may also communicate with one or more sub-controllers configured to operate one or more subsystems in the printer 100.

The controller is coupled to an actuator 196 that rotates the image receiving member. The actuator is an electric motor that the controller may operate at multiple speeds or halt to carry out the printing process timing sequence. The controller of the present embodiment also generates signals for operating the components that position the transfix roller with reference to the image receiving member.

In operation, image data corresponding to an ink image are sent to the controller 180 from either of the scanning system 176 or via the online or workstation connection 190 for processing and output to the printhead assemblies 132 and 134. Additionally, the controller determines and/or accepts related subsystem and component controls, for example, from operator inputs via the user interface 186, and executes such controls accordingly. As a result, the printhead assemblies receive ink melted from appropriate solid forms of differently colored phase change ink. The printhead assemblies eject ink droplets in response to firing signals generated by the controller to form images on the imaging surface 114 that correspond with the image data. Media sources 142, 144, and 148 may supply media substrates to the substrate system 150 in timed registration with image formation on the surface 114.

After image fixation, media sheet 149 passes clear ink printhead assembly 136. Clear ink printhead assembly 136 is operatively coupled to controller 180. Controller 180 may operate clear ink printhead assembly 136 to apply selected halftone levels of clear ink to different areas of the media sheet 149 using a process such as process 400 described below. Clear ink printhead assembly ejects clear ink directly onto the media sheet 149, forming halftone patterns similar to those depicted in FIG. 3B. The halftone pattern of clear ink covering ink images formed on the media sheet 149 protects underlying ink from damage due to ink abrasion. Clear ink applied directly to media sheet 149 changes the gloss level of the print medium.

Figure 4:
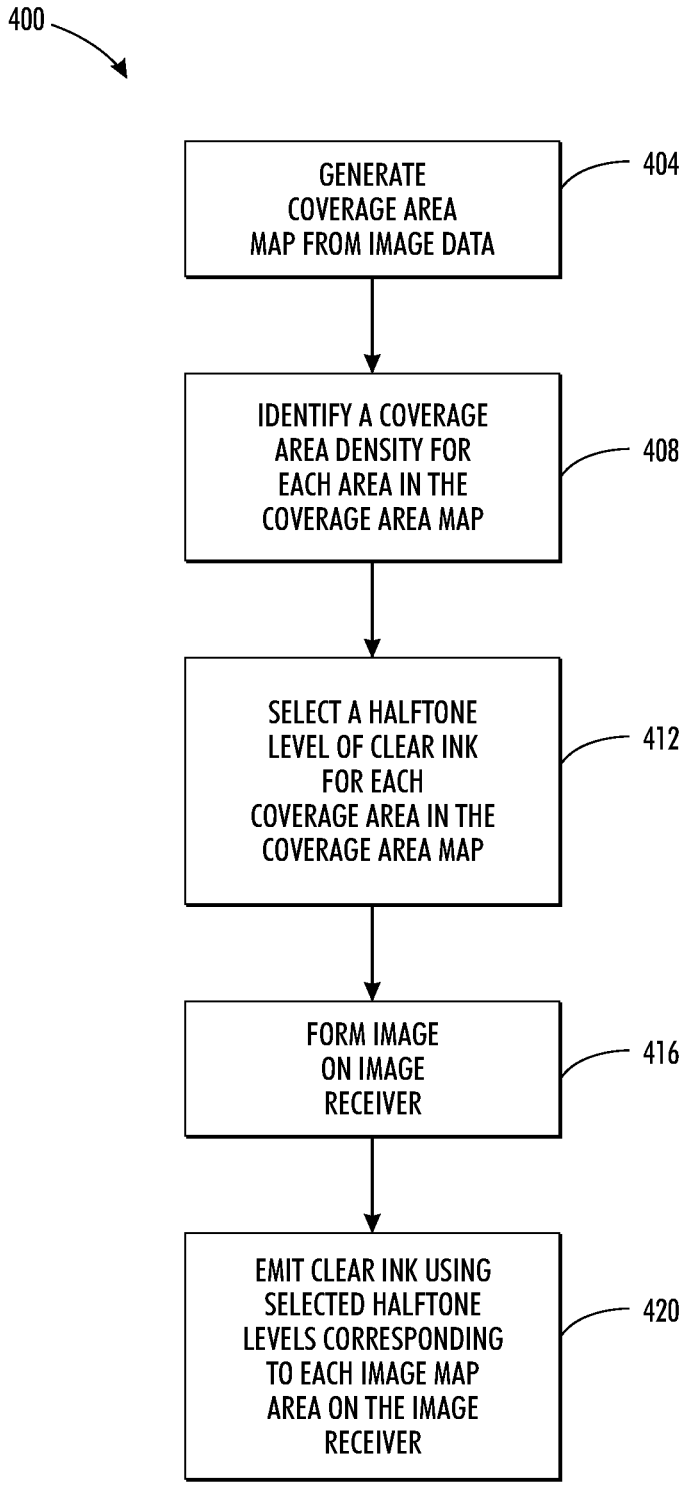
FIG. 4 is a block diagram of a process for identifying areas of an image and applying halftone patterns of clear ink at different levels in the identified areas of the image.

FIG. 4 shows a process 400 for selecting and applying halftone patterns of clear ink to a print medium. Process 400 begins by generating a coverage area map from image data (block 404). The image data may include information on the pixel position, color, and ink density levels of an ink image formed on the image receiving member. In some embodiments the image data may be the same data provided to the imaging system to form the ink image on the image receiving member. In alternative embodiments, detectors, such as optical sensors 54 shown in FIG. 1A and FIG. 1B, may generate image data corresponding to each pixel on the image receiving member after the ink image is formed. In images formed from multiple colors, each color occupies one plane in the image data. For example, in a CMYK imaging device, image data for each of the cyan, magenta, yellow, and black colors occupies an individual plane. Each pixel location on the image receiving member may receive an ink drop from each of the ink colors present in the imaging device. Thus, in an exemplary CMYK printing system, a single pixel could correspond to no ink drops, indicating a bare pixel location, or any combination of some or all of the CMYK colors. The coverage area map uses image data in each color plane to identify regions of pixels having different densities of ink drops formed on the pixels. The image coverage map groups regions of pixels having similar densities of ink drops together using various techniques known to the art including thresholding, averaging, edge detection, and clustering of the image data.

Figure 5:
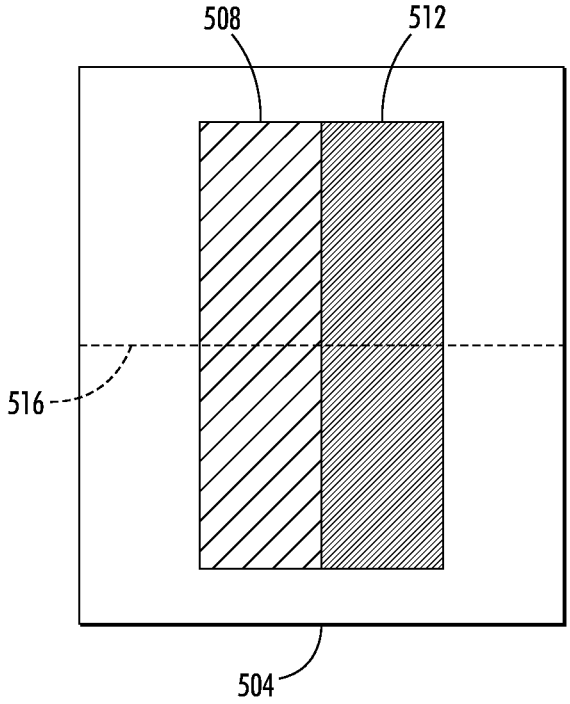
FIG. 5 is an exemplary ink image formed on an image receiving member.

FIG. 5 shows a visual depiction of different areas 504, 508, and 512 of an ink image. In FIG. 5, region 504 includes bare substrate including no ink drops formed on the pixel locations in the region. Region 508 corresponds to a halftoned region where ink drops occupy a portion of the pixels. Halftoned regions may have varying densities where less dense halftoned regions have a lower proportion of pixels containing ink drops, while denser regions include a higher proportion of pixels containing ink drops. Region 512 corresponds to an area of the image where each pixel includes an ink drop, which may also be referred to as a halftone area with 100% density. One method of identifying areas in the image coverage map identifies areas in linear arrangements of image data for each line of pixels in an image, such as line 516. Alternative area shapes may include multi-dimensional regions forming tessellated polygons, such as rectangles or triangles, or amorphous shapes formed from groups of individual pixels in the image data.

Figure 6:
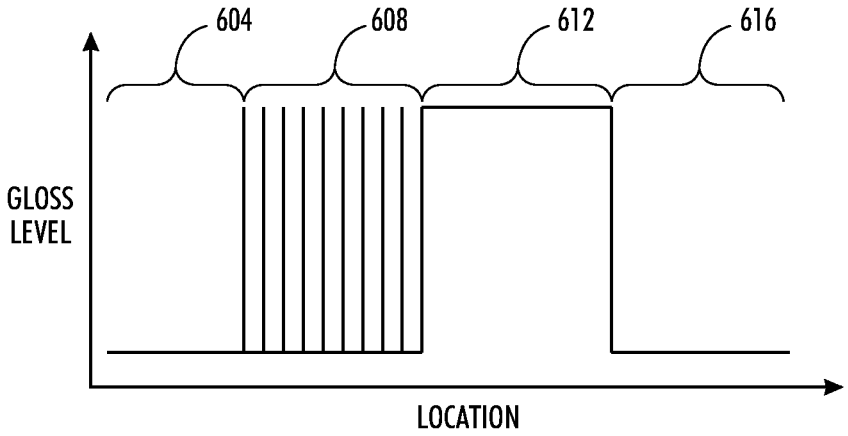
FIG. 6 is a graph of gloss levels representing gloss levels in image data taken along line 516 in FIG. 5.
Figure 7A:
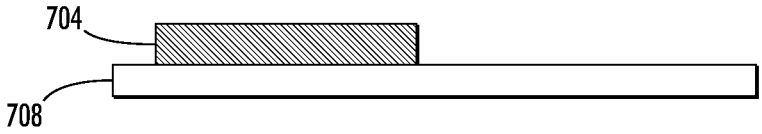
FIG. 7A PRIOR ART
FIG. 7A is cross-sectional view of a print medium with a partially imaged surface produced by a prior art printing process.
Figure 7B:
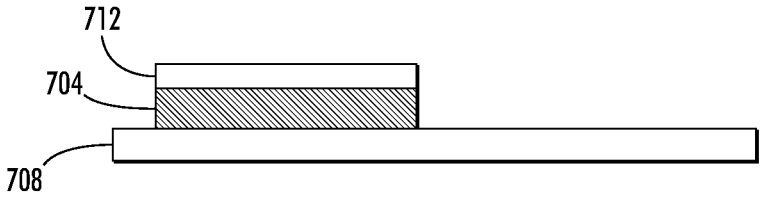
FIG. 7B PRIOR ART
FIG. 7B is an alternative cross-sectional view of a print medium with a partially imaged surface and an overcoat layer produced by a prior art printing process.

FIG. 6 shows a representation of gloss levels corresponding to image data taken along line 516 in FIG. 5. The Y axis of FIG. 6 indicates the gloss level of image data at a particular pixel location on the X axis. A high gloss level indicates that ink is present on a given pixel, while a low gloss level indicates that the pixel location is bare. In the example of FIG. 6, two levels of gloss are depicted, but alternative image data may indicate different levels of gloss corresponding to different colors of ink in different color planes in the image data. As see in FIG. 6, image data areas 604 and 616 have low gloss levels corresponding to bare media region 504, area 612 has a continuous high gloss level corresponding to solid ink region 512, and area 608 has a series of high and low points corresponding to halftone region 508. The image coverage map for the image data in FIG. 6 includes the positions of pixels in each of areas 604-616.

Each area in the image coverage map includes pixels with a given density of ink covering the pixels, known as the coverage area density for each area in the image coverage map. The image data may provide the coverage area densities, or the coverage area densities may be identified from analysis of the image data (block 408). Each area of ink in the image coverage map includes a region of pixels having similar densities of the various inks used to form the image. One method of identifying a coverage area density in a given area of the image coverage map includes averaging the gloss level of image data corresponding to each pixel in the area. In an example area, such as area 612 in FIG. 6, the gloss level could be 100% where each pixel location in an area is covered with ink. In imaging devices employing inks with non-uniform gloss levels, identification of the coverage area density may include weighting gloss level data for different color planes to account for the different gloss levels of each ink color.

Referring again to FIG. 4, process 400 selects a halftone level of clear ink corresponding to each coverage area in the coverage area map (block 412). In general, the coverage area densities may be compared to one or more predetermined thresholds to classify an area identified by the coverage area map. The thresholds may be used to classify an area identified by the coverage area map as being a solid area, a halftoned area, or a bare area. A predetermined halftone level may then be selected with reference to the area classification.

More specifically, the halftone level may be selected in response to the relative gloss levels of print media and inks, identified coverage area density in each area of the coverage area map, and/or in response to other factors, such as manually generated parameters governing the use of halftones. The print medium may have a known gloss level or have a gloss level measured using various devices including gloss meters and the like. The inks selected for use in the imaging device, including the colored inks and the clear ink, may also have known gloss levels. The gloss levels for both the print media and inks may be supplied to the imaging device controller for selection of halftone clear ink coverage levels in each coverage area in the coverage area map. The gloss level of each coverage area in the coverage area map may be identified using the known print media and ink gloss levels, and predetermined halftone levels of clear ink may be selected to change the gloss level in one or more areas of the coverage area map.

In one example, a coverage area map corresponds to an ink image formed on a print medium with a low gloss level, such as plain paper, with inks having a high gloss level. The bare portions of the print medium have the lowest gloss levels, the portions of the print medium that are fully covered with ink have the highest gloss levels, and different portions of the print medium with various halftone ink levels have intermediate gloss levels that are proportionate to the density of the halftoned ink. Thus, in an imaging mode that seeks to reduce non-uniformity in gloss levels for an entire image, an example selection of clear ink halftone levels may include a halftone density of 60% on portions of the coverage area map where the coverage area density is 0%, while portions of the coverage area map with coverage area densities at or above 100% may receive no clear ink. Predetermined clear ink halftone levels are selected for areas in the coverage area map that correspond to coverage areas with intermediate coverage area densities in response to the identified coverage area density in each area.

In another imaging mode, areas in the coverage area map having high coverage area densities may receive a minimum clear ink halftone level to protect ink in the high density areas, while areas in the image coverage map with low or zero coverage area densities may receive higher clear ink halftone levels to reduce differences in gloss levels. Thus, while selected clear ink halftone levels may vary between different embodiments and operating modes, each area of the coverage area map receives a halftone level of clear ink that is selected with reference to the gloss level identified from the coverage area density of colored ink in the coverage area map.

Process 400 forms an image with ink corresponding to one or more colors on an image receiving member (block 416). The image formation process may occur in a direct or indirect imaging system as exemplified above in FIG. 1A, FIG. 1B, and FIG. 2. While FIG. 4 depicts image formation (block 416) occurring after the other processing (blocks 404-412), various imaging device embodiments may form ink images prior to or concurrently with any or all of processing shown in blocks 404-412. In imaging system embodiments that generate image data for the coverage area map using one or more sensors that detect images formed on the image receiving member, formation of an ink image (block 416) occurs prior to generation of the coverage area map (block 404).

After forming an ink image on the image receiving member, process 400 forms halftones of clear ink over each area of the image receiving member (block 420). The coverage area map provides pixel locations on the image receiving member for which clear ink is ejected at a selected halftone level. The selected halftone levels provide the clear ink halftone level that is applied in each area on the image receiving member. The clear ink may land on bare pixel locations on the image receiving member and change the gloss level of the image receiving member. The clear ink may also land on color ink formed on the image receiving member, changing the gloss level and providing a protective coating on the colored ink. Clear ink ejectors may eject the clear ink prior to or after spreading of ink on the image receiving member during the imaging process. In multi-pass printing systems, the print medium may pass a clear ink ejector multiple times during an imaging process.

Using the process described above, appropriate halftone levels for different areas of a printed medium are identified with reference to the coverage area map and used to regulate the amount of clear ink ejected onto the different areas of the printed medium. Consequently, the gloss levels presented by the printed medium after the medium exits the printing device can be more effectively controlled. If uniform gloss levels are desired, the process can select the halftone levels for the clear ink to compensate for the different gloss levels presented by different densities of ink contained in different areas and for the gloss level presented by the bare areas of the printed medium. Additionally, an appropriate amount of clear ink is applied to the different areas of an ink image to protect the ink from abrasion in a more efficient manner. Thus, the coverage area map described above enables more efficient, flexible, and robust application of clear ink for different ink images and media than previously known coating techniques.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

I claim:

1. A method of inkjet printing comprising:

receiving digital data corresponding to an image to be printed with an inkjet printing apparatus;

generating a coverage area map that identifies areas of the image to be printed that have different coverage area densities;

identifying a coverage area density for each area identified by the coverage area map, the coverage area density for each area being identified by weighting gloss level data differently for each color plane in an area identified in the coverage area map;

selecting a halftone level for clear ink to be ejected onto each area identified by the coverage area map, the halftone level selected for each area corresponding to the coverage area density for the area;

operating a first plurality of inkjet ejectors for the inkjet printing apparatus to form the image to be printed on an image receiving member with at least one colored ink; and operating a second plurality of inkjet ejectors to eject clear ink at the selected halftone levels onto the image receiving surface, the second plurality of inkjet ejectors being operated with reference to the selected halftone levels to eject different amounts of clear ink onto the different areas identified by the coverage area map.

2. The method of claim 1 further comprising:

spreading the at least one colored ink used to form the image to be printed on the image receiving member after the second plurality of inkjet ejectors have been operated to eject the clear ink onto the image receiving member.

3. The method of claim 1 further comprising:

spreading colored ink used to form the image to be printed on the image receiving member before the second plurality of inkjet ejectors have been operated to eject the clear ink onto the image receiving member.

4. The method of claim 1, the identification of the coverage area density further comprising:

identifying a ratio of colored ink pixels to a total number of available pixels for an area identified by the coverage area map.

5. The method of claim 1 further comprising:

comparing the identified coverage area density for each area in the coverage area map to at least one predetermined threshold to classify each area identified by the coverage area map.

6. The method of claim 5 further comprising:

classifying an area identified by the coverage area map as being one of a solid area, a halftoned area, and a bare area.

7. The method of claim 6 further comprising:

selecting the halftone level with reference to the area being classified as a solid area, a halftoned area, or a bare area.

8. A printer comprising:

a media transport system configured to transport print media along a media path;

a print station positioned along the media path, the print station including a first plurality of inkjet ejectors configured to eject drops of ink having at least one color;

a clear ink station positioned along the media path, the clear ink station including a second plurality of inkjet ejectors configured to eject drops of clear ink; and a controller, the controller configured to:

receive digital data corresponding to an image to be printed with an inkjet printing apparatus;

generate a coverage area map that identifies areas of the image to be printed that have different coverage area densities;

identify a coverage area density for each area identified by the coverage area map by weighting gloss level data differently for each color plane in an area identified in the coverage area map;

select a halftone level for clear ink to be ejected onto each area identified by the coverage area map, the halftone level selected for each area corresponding to the coverage area density for the area;

operate the media transport system to move the print media past the print station and clear ink station;

operate the first plurality of inkjet ejectors in the print station with reference to the digital data to form an image on a surface of the print media by ejecting ink drops having the at least one color; and operate the second plurality of inkjet ejectors in the clear ink station to eject clear ink at the selected halftone levels onto the image receiving surface, the second plurality of inkjet ejectors being operated with reference to the selected halftone levels to eject different amounts of clear ink onto the different areas identified by the coverage area map.

9. The printer of claim 8 further comprising:

a spreading station configured to spread ink drops ejected by the print station across the surface of the print media, the spreading station positioned along the media path between the print station and the clear ink station.

10. The printer of claim 8 further comprising:

a spreading station configured to spread ink drops ejected by the print station across the surface of the print media, the spreading station positioned along the media path at a position that enables the spreading station to spread the clear ink ejected by the clear ink station onto the print media.

11. The printer of claim 8, the controller being further configured to identify a ratio of colored ink pixels to a total number of available pixels for each area identified by the coverage area map.

12. The printer of claim 8, the controller being further configured to compare the identified coverage area density for each area identified by the coverage area map to at least one predetermined threshold to classify each area identified by the coverage area map.

13. The printer of claim 12, the controller being further configured to classify an area identified by the coverage area map as being one of a solid area, a halftoned area, and a bare area.

14. The printer of claim 13, the controller being further configured to select the halftone level with reference to the area being classified as a solid area, a halftoned area, or a bare area.

15. A printer comprising:

an image receiving member;

a transfix member;

a media transport system configured to transport print media along a media path;

a print station positioned opposite the image receiving member, the print station including a first plurality of inkjet ejectors configured to eject drops of ink having at least one color;

a clear ink station positioned along the media path, the clear ink station including a second plurality of inkjet ejectors configured to eject drops of clear ink; and a controller, the controller configured to:

receive digital data corresponding to an image to be printed with an inkjet printing apparatus;

generate a coverage area map that identifies areas of the image to be printed that have different coverage area densities;

identify a coverage area density for each area identified by the coverage area map by weighting gloss level data differently for each color plane in an area identified in the coverage area map;

select a halftone level for clear ink to be ejected onto each area identified by the coverage area map, the halftone level selected for each area corresponding to the coverage area density for the area;

operate the media transport system to move the print media between the image receiving member and the transfix member and past the clear ink station;

operate the first plurality of inkjet ejectors in the print station with reference to the digital data to form an image on the image receiving member by ejecting ink drops having the at least one color;

operate the transfix member and image receiving member to transfix the image onto a surface of a print medium; and operate the second plurality of inkjet ejectors in the clear ink station to eject clear ink at the selected halftone levels onto the surface of the print medium, the second plurality of inkjet ejectors being operated with reference to the selected halftone levels to eject different amounts of clear ink onto the different areas identified by the coverage area map.

16. The printer of claim 15 further comprising:

a spreading station configured to spread the clear ink ejected by the clear ink station across the surface of the print medium.

17. The printer of claim 15, the controller being further configured to identify a ratio of colored ink pixels to a total number of available pixels for each area identified by the coverage area map.

18. The printer of claim 15, the controller being further configured to compare the identified coverage area density for each area identified by the coverage area map to at least one predetermined threshold to classify each area identified by the coverage area map.

19. The printer of claim 18, the controller being further configured to classify an area identified by the coverage area map as being one of a solid area, a halftoned area, and a bare area.

20. The printer of claim 19, the controller being further configured to select the halftone level with reference to the area being classified as a solid area, a halftoned area, or a bare area.

* * * * *